United States Patent [19]

Itagaki

[11] Patent Number: 5,020,293

[45] Date of Patent: Jun. 4, 1991

[54] DECORATIVE PANEL ASSEMBLY

[75] Inventor: Takafumi Itagaki, Chiba, Japan

[73] Assignee: Tamatoshi Industries Limited, Tokyo, Japan

[21] Appl. No.: 459,349

[22] Filed: Dec. 29, 1989

[30] Foreign Application Priority Data

Jan. 27, 1989 [JP] Japan ..... 1-19092
Jan. 27, 1989 [JP] Japan ..... 1-19093

[51] Int. Cl.[5] ..... E04F 13/00

[52] U.S. Cl. ..... 52/314; 52/489; 52/508; 52/511; 52/512; 52/DIG. 4; 248/223.4

[58] Field of Search ..... 52/315, DIG. 4, 314, 52/508, 509, 510, 511, 489; 248/206.5, 223.4, 225.1

[56] References Cited

U.S. PATENT DOCUMENTS

| | | | |
|---|---|---|---|
| 1,150,594 | 8/1915 | Hale | 52/508 |
| 2,954,257 | 9/1960 | Besuch et al. | 248/206.5 |
| 3,200,551 | 8/1965 | Jakeway | 52/511 |
| 3,225,504 | 12/1965 | Gregoire | 52/509 |
| 3,499,673 | 3/1970 | Soltysik et al. | 52/509 X |
| 3,982,370 | 9/1976 | Buffington | 52/481 |
| 3,998,016 | 12/1976 | Ting | 52/508 |
| 4,058,335 | 11/1977 | Abe | 248/206.5 X |
| 4,155,206 | 5/1979 | Player | 52/508 |
| 4,223,490 | 9/1980 | Medow | 52/314 X |
| 4,586,616 | 5/1986 | Cooper et al. | 248/206.5 X |
| 4,887,783 | 12/1989 | Franklin | 248/225.1 X |

FOREIGN PATENT DOCUMENTS

| | | | |
|---|---|---|---|
| 2718463 | 11/1978 | Fed. Rep. of Germany | 52/511 |
| 2307218 | 11/1976 | France | 52/489 |
| 444608 | 2/1949 | Italy | 52/508 |
| 685922 | 3/1965 | Italy | 52/483 |
| 590984 | 8/1977 | Switzerland | 52/511 |
| 649165 | 1/1951 | United Kingdom | 248/223.4 |

*Primary Examiner*—Richard E. Chilcot, Jr.
*Assistant Examiner*—Deborah McGann Ripley
*Attorney, Agent, or Firm*—Cushman, Darby & Cushman

[57] ABSTRACT

A decorative panel assembly which are adapted to be mounted on a mounting surface such as a wall surface, wherein a decorative panel is attached to the mounting surface by means of a magnetic securing device. The decorative panel is provided with pairs of legs from which an engaging portion is horizontally protruded. The securing device is also provided with a fin or a groove which is adapted to be engaged with the engaging portion of the decorative panel, thereby allowing the decorative panel to be mounted to the mounting surface by means of the securing device.

9 Claims, 9 Drawing Sheets

DECORATIVE PANEL ASSEMBLY

BACKGROUND OF THE INVENTION (a). Field of the Invention

This invention relates to a decorative panel assembly which is adapted to be fixed to a mounting surface through a securing device provided with a magnet.

(b). Description of the Prior Art

Conventionally, a decorative panel, which is designed to be mounted on a wall surface side by side for decorating the wall surface, is fastened to the wall surface by means of screw or bolt which is applied from the front surface of the decorative panel. Accordingly, the head portion of the screw or bolt is inevitably exposed to the interior of the room decorated with the decorative panels, thereby spoiling the decorative function of the decorative panel.

Moreover, since the decorative panel is designed to be mounted on the wall surface side by side in a horizontal direction or a vertical direction, an engaging means is provided at both sides of each panel so as to be engaged with an adjacent decorative panel.

When the decorative panel is mounted on a wall surface by keeping the front surface of the decorative panel spaced apart from the wall surface by means of the engaging means as mentioned above, a fastening means such as a screw is inevitably exposed, thus spoiling the decorative panel.

Moreover, when it is desired to dismount the decorative panel after the decorative panel is once fastened to a wall surface, the fastening means such as screw or bolt are required to be taken out again. Accordingly, the exchange operation of the decorative panel is troublesome and time consuming.

SUMMARY OF THE INVENTION

Accordingly, the main object of this invention is to provide a decorative panel assembly which is very easy and simple to mount and to remove from a mounting surface such as a wall surface.

In order to achieve the above object, a securing device capable of magnetically adhering a decorative panel to a mounting surface has been employed according to this invention. Thus, each decorative panel can be fixed to a wall surface independently from one another. Accordingly, there is provided according to this invention a decorative panel assembly comprising:

- a securing device provided therein with a magnet and adapted to be magnetically adhered to a mounting surface; and
- a decorative panel adapted to be fixed to said securing device, and having a front surface, a back surface and a leg member extending backward from the back surface thereof in such a manner that a space is formed behind the decorative panel when said panel is fixed to the mounting surface through said securing device;
- said leg member being provided with an engaging portion to be engaged with said securing device so as to prevent said decorative panel from being detached from said mounting surface.

BRIEF DESCRIPTION OF THE DRAWINGS

FIG. 4(*b*) is a perspective view of a securing device showing a disintegrated state of the securing device;

FIG. 4(*c*) is a front view of the securing device shown in FIG. 4(*b*);

DESCRIPTION OF THE PREFERRED EMBODIMENTS

Figure 1:
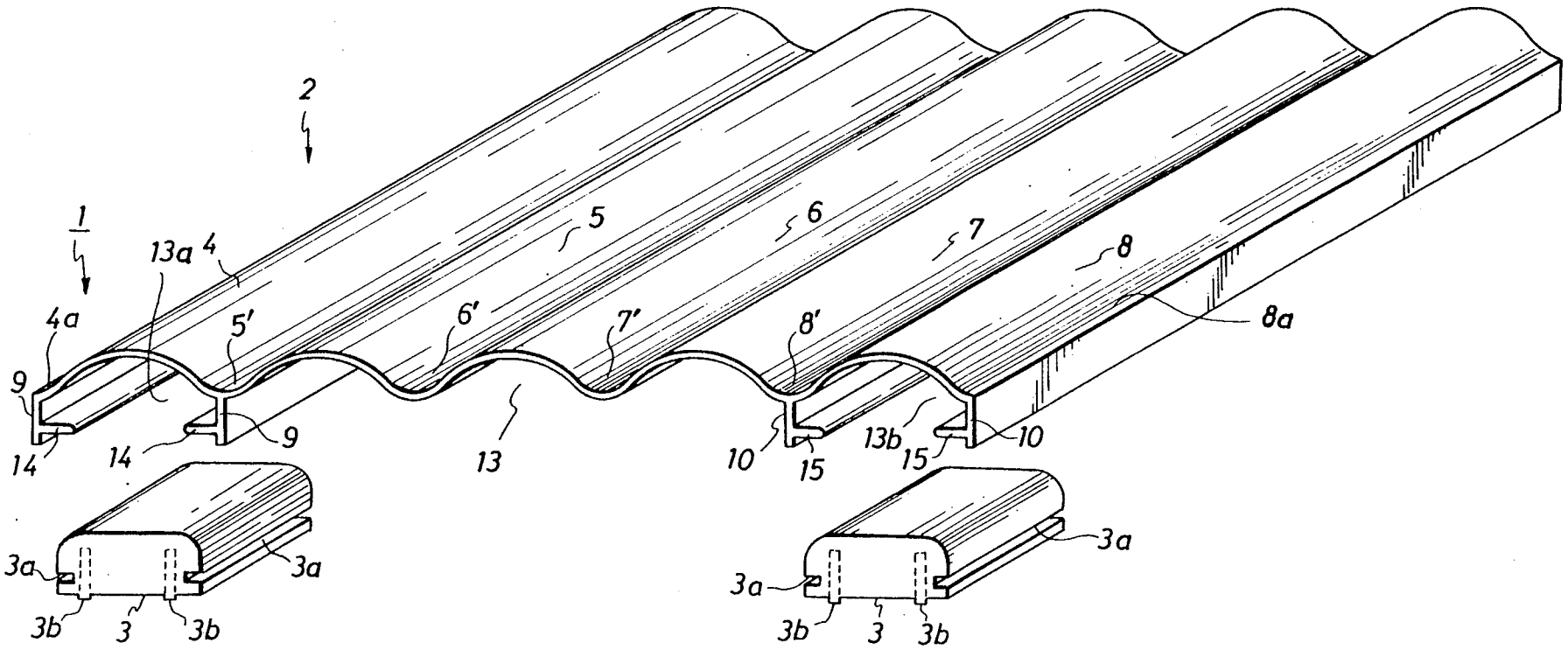
FIG. 1 is a perspective view of a decorative panel assembly according to an embodiment of this invention.

This invention will be further explained with reference to the embodiments shown in the drawings.

A decorative panel assembly shown in FIG. 1 comprises a decorative panel 2 having a wave-like cross-section or of a corrugated shape, and a securing device 3 for fixing the decorative panel 2 in place. This decorative panel 2 is mounted to a mounting surface such as wall surface one by one, thereby forming a continuous sequence of the decorative panels 2 along the mounting surface.

Each unit of the decorative panel 2 comprises a plurality of ridge portions 4 to 8 of an arc-like cross-section, a plurality of trough portions 5' to 8' formed between the neighboring ridges, and a pair of half-trough portions 4*a* and 8*a* formed at both sides of the panel 2.

From the back surfaces of the ridge portions located on both sides of the panel 2, to be more specific, from the back surfaces of the trough portions 4*a* and 5' on one hand, 8' and 8*a* on the other hand are respectively projected one pair of legs 9 and 9 facing each other, and another pair of legs 10 and 10 facing each other. Due to the presences of these legs 9, and 10, a space 13 conforming to the back surface of the panel 2 is formed between the panel 2 and a mounting surface 12 when the panel 2 is fixed to the mounting surface 12.

A pair of rib-like engaging portions 14 are vertically extended from the legs 9 to face each other. Likewise, from the legs 10 are also vertically extended a pair of rib-like engaging portions 15 facing each other.

On both sides of the securing device 3 are provided each with a groove 3*a* so as to be slidably engaged with the engaging portions 14 and 15. The upper portion of the securing device 3 may be flat or formed into a semi-cylindrical shape, and adapted to engage with the back surface of the ridge portions 4 and 8.

A pair of plate-like leg members 3*b* made of magnet or magnetic material are buried in the left and right portions of the securing device 3 in such a manner that only lowest tip portions thereof are exposed from the bottom of the securing device 3, so that these exposed portions can be magnetically adhered to the mounting surface 12.

Figure 2:
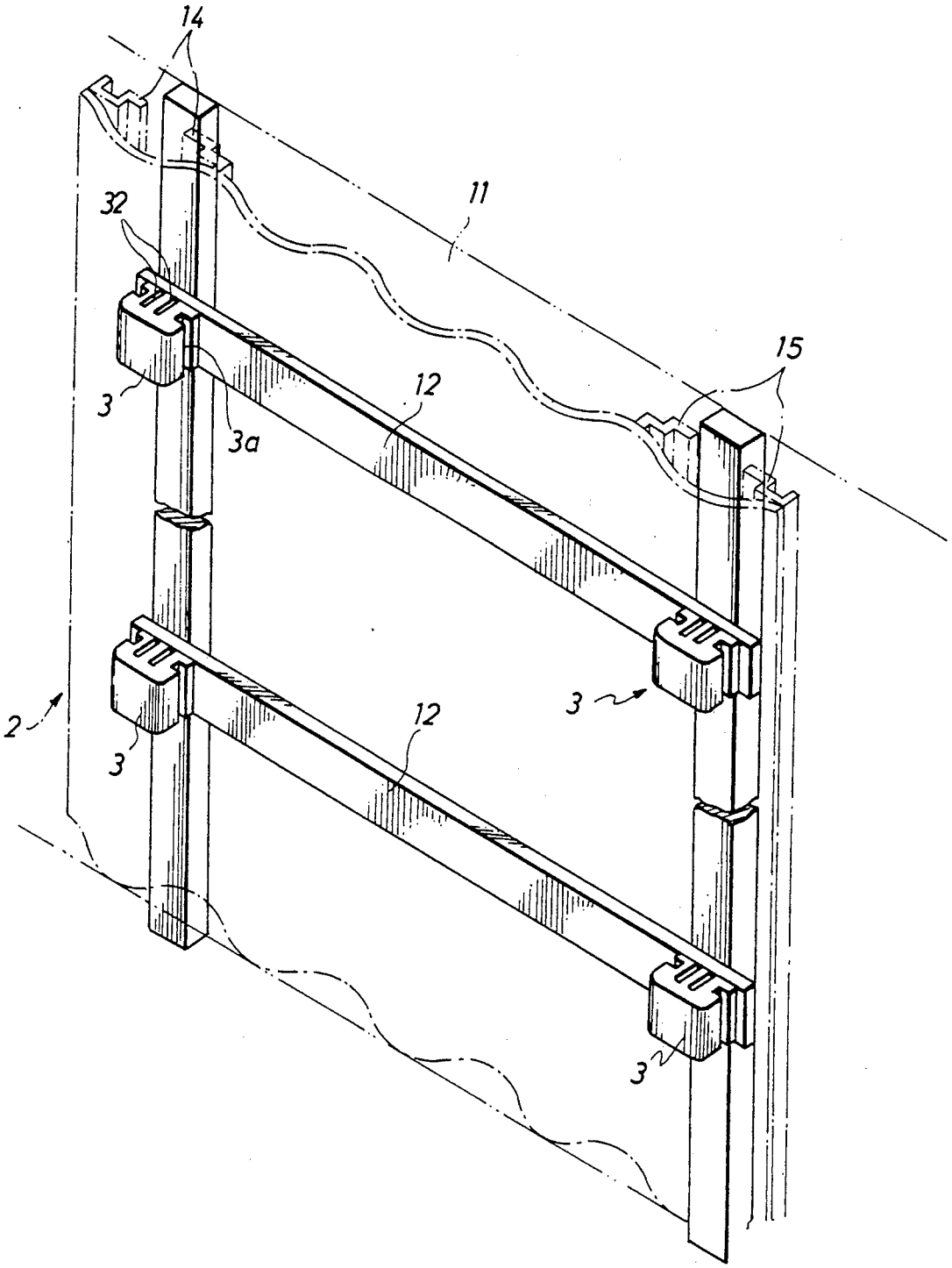
FIG. 2 is a perspective view of a mounting surface for explaining a mounting operation of the decorative panel assembly shown in FIG. 1.

The mounting surface 12 is arranged as shown in FIG. 2 along the wall surface 11. This mounting surface 12 may be made from iron material or other magnetic material. It is also possible that the mounting surface 12 itself may be an ordinary wall surface. In any case, the leg member 3*b* of the securing device 3 can be magnetically adhered to the mounting surface.

When the decorative panel 2 is to be fixed to the mounting surface 12, the securing device 3 is magnetically adhered to predetermined locations of the mounting surface 12 (for example, the locations which correspond to the upper and lower ridge portions 4 and 8 disposed at both sides of the decorative panel 2, i.e. four corner portions of the decorative panel 2), and then the decorative panel 2 is fixed to the securing device 3 by slidably fitting the engaging portions 14 and 15 into the groove 3*a*. In this manner, the decorative panel 2 can be fixed to the mounting surface 12 by means of the securing device 3.

In this case, each of the securing devices 3 is completely received within the spaces 13*a* and 13*b*, and hidden from outside, thereby raising no problem to the decorative function of the decorative panel 2.

Since it is possible to mount the decorative panel 2 independently from the decorative panels 2 neighboring thereto, the replacement or change of the decorative panel 2 can be easily carried out.

Figure 3:
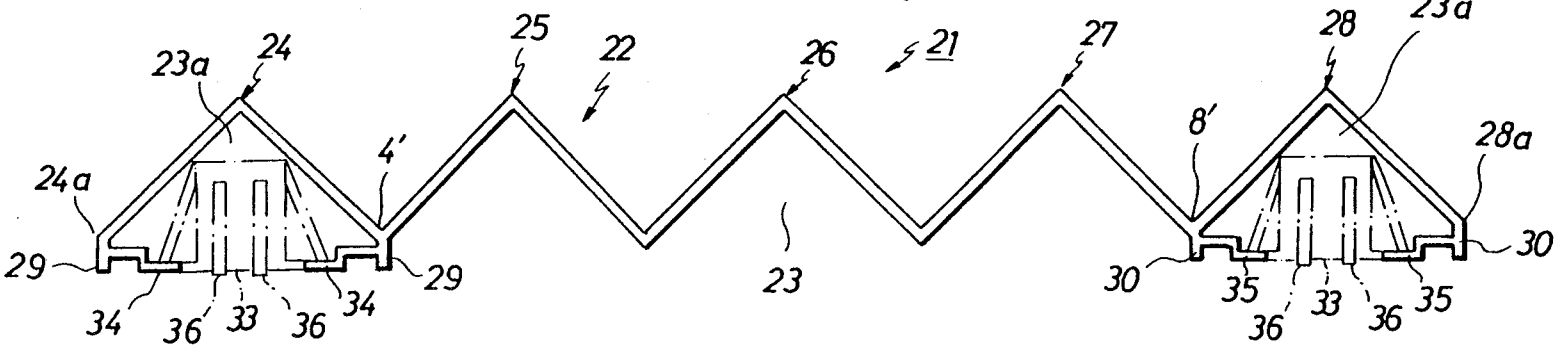
FIG. 3 is a top view or a decorative panel assembly according to another embodiment of this invention.

FIG. 3 shows another example of the decorative panel assembly of this invention, wherein the decorative panel 21 comprises a plurality of ridge portions 24 to 28 having a triangular cross-section.

In this case, accordingly, the space 23 to be formed behind the decorative panel 22 when it is assembled differs from that shown in FIG. 1.

On both sides of the decorative panel 22 are disposed each with a space 23*a* in which a securing device 33 can be fitted in with its upper portion being contacted to the back surface of the ridge portion 24 or 28 as shown in dotted lines. In this case, the securing device 33 is slidably engaged with a pair of engaging portions 34 formed on the legs 29, or with a pair of engaging portions 35 formed on the legs 30 of the decorative panel 22, thereby fastening the decorative panel 22 to a mounting surface.

Inside this securing device 33 are accommodated a pair of magnetic legs 36 disposed in parallel and spaced apart from each other. There legs 36 are so designed as to be magnetically adhered to the mounting surface 12 in the same manner as explained in the above embodiment.

By fitting the securing devices 33 in the spaces 23*a*, the decorative panel 22 can be separately fastened to the mounting surface 12.

Figure 4:
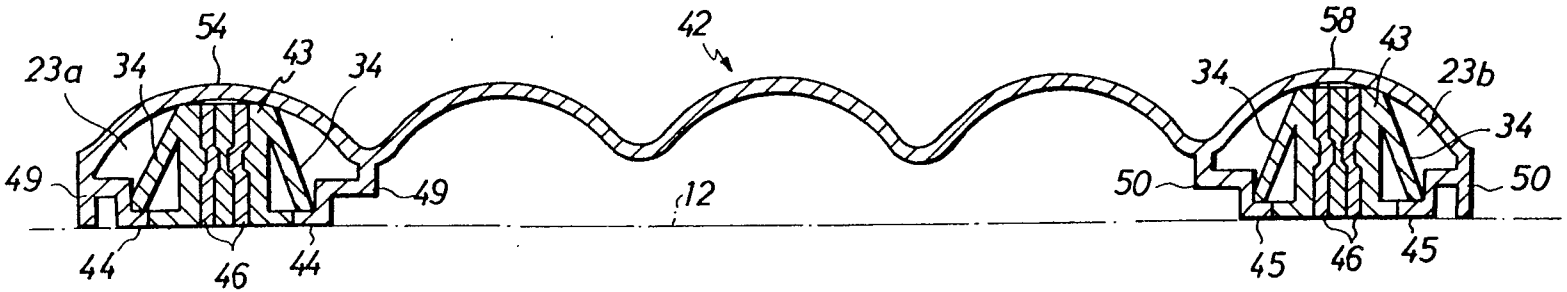
FIG. 4(*a*) is a top view of a decorative panel assembly according to another embodiment of this invention.
Figure 4B:
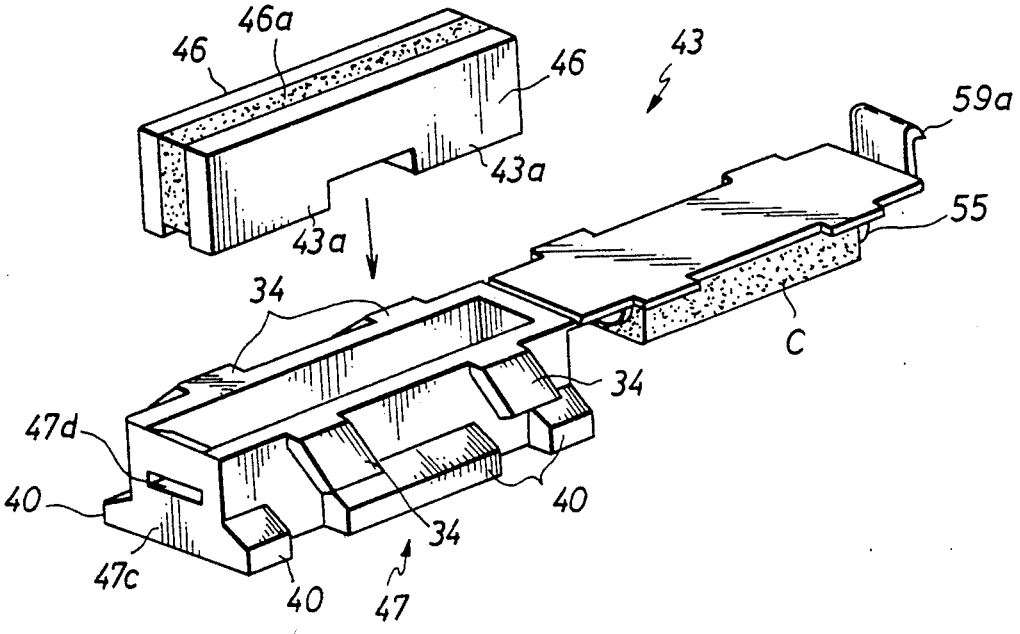
Figure 4C:
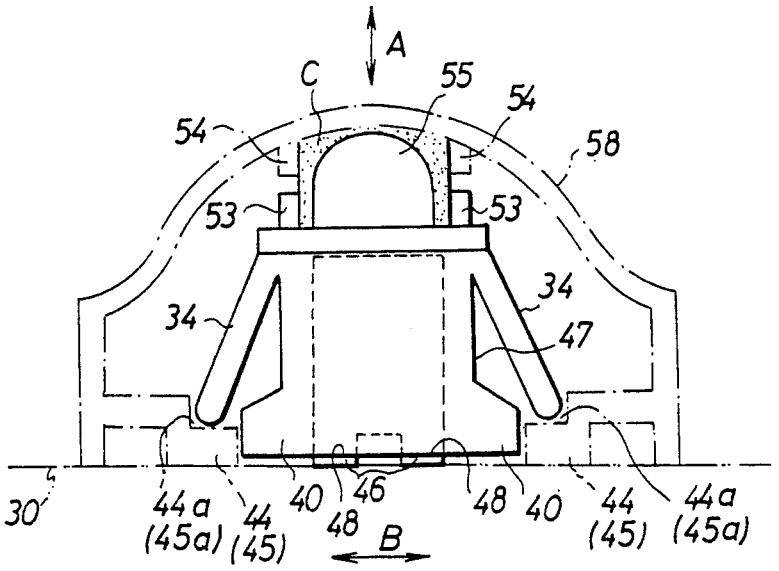

FIG. 4(*a*) shows another embodiment of decorative panel assembly in which the decorative panel 42 comprises two pair of legs 49 and 50 on both sides thereof. A pair of step-like engaging portions 44 are extended toward each other from the lower part of the legs 49. Likewise, a pair of step-like engaging portions 45 are extended from the lower part of the legs 50.

On the other hand, a pair of resilient fins 34 are provided to a securing device 43 for engaging with the engaging portions 44 and 45. More specifically, a pair of fins 34 are extended diagonally downward from both upper sides of the securing device 43, so that the lower ends of fins 34 are slightly spaced apart from the side walls of the securing device 43. It is possible with this pair of fins 34 to hold the engaging portions 44 and 45, thereby to fasten the decorative panel 42 to a mounting surface 12.

To be more specific, when the decorative panel 42 is pressed over the securing device 43 magnetically adhered to the mounting surface 12 in advance, the fins 34 are pressed between a pair of the engaging portions 44 and 45 thereby being caused to be bent inward or toward the side walls of the securing device 43, thereby allowing the fins 34 to pass through a space between the engaging portions 44 or 45, when the fins 34 are completely admitted into a pair of legs 49 or 50, the top surface of the securing device 43 is contacted with the back surface of the ridge portions 54 or 58, and at the same time, the fins 34 are expanded to their original states due to their resiliency thereby pressing the upper surfaces of the engaging portions 44 and 45.

FIGS. 4(*b*) and 4(*c*) show details of the securing device 43. The securing device 43 comprises a housing 47 having four openings two of which are indicated at 48 on its bottom. Legs 46 made of a magnetic material and holding a magnet 46*a* therebetween are housed in housing 47 in such a manner that lower end portions of the legs 46 are partially protruded from the openings 48. A cap 59 for closing the upper opening of the housing 47 is pivotally connected to one upper side of the housing 47 by means of a hinge H.

A pair of fins 34 are integrally attached to each upper side edge portion of the housing 47 leaving a space therebetween. The lower end of each of the fins 34 is extended down to near the bottom surface of the housing 47. The lower portions of both sides of the housing 47 that do not overlap with the lower ends of the fins 34, i.e. right and left portions, and central portion of the side of the housing 47, are horizontally and outwardly protruded thereby forming a guiding side wall 40. Accordingly, the lower ends of the fins 34 can be bent toward the side wall of the housing 47 without colliding with the protruded guiding side wall 40.

On the front wall 47*c* of the housing 47 which is opposite to the wall where the cap 59 is hinged is provided with an engagement hole 47*d*.

The cap 59 is hinged via V-grooved hinge H as mentioned above to the housing 47 in order to close the upper opening for introducing the legs 46. On the inner side of the free end portion of the cap 59 is provided a claw 59*a* approximately vertically projected therefrom. The claw 59*a* is so designed as to be detachably engaged with the engagement hole 47*d* by being inserted from the inner side of the front wall 47*c*.

By merely closing the upper opening of the housing 47 with the cap 59 and at the same time engaging the claw 59*a* with the hole 47*d*, the legs 46 can be instantly fixed within the housing 47.

A pair of upwardly projecting ribs 53 are disposed as shown in FIG. 4(*c*) on the upper surface of the cap 59 along the length of the cap 59. These ribs 53 are so designed as to be contacted with a pair of ribs 54 projecting from the back surface portion of the space 23*a* of the decorative panel 42.

A block-like buffering member 55 made of for example, polyurethane may preferably be disposed between the pair of ribs 54 so as to protrude higher than the height of the ribs 54.

As explained above, the fins 34 act to hold the engaging portions 44 and 45 thereby preventing the decorative panel 42 from being detached from the mounting surface 12. In this case, if the inclination angle of the fins 34 is too large, the lower ends of the fins 34 may be slipped outward on the upper surface of the engaging portions 44 and 45 thereby destroying the fixing effect of the fins 34. Therefore, the inclination angle of the fins 34 should be selected to a suitably small range, and at the same time the outward slipping of the fins 34 should be prevented by forming a step portion 44*a* and 45*a* on the upper surface of the engaging portions 44 and 45.

With this construction, it is possible to prevent the shaking in the direction "A" (FIG. 4(*c*)) of the decorative panel 42.

Since the guiding side wall 40 is extended outward from the both sides of the housing 47, so as to be snugly fitted in between the space between the engaging portions 44 and 45, the shaking of the decorative panel 42 in the direction "B" (FIG. 4(*c*)) can be prevented.

Accordingly, once the decorative panel 42 is fastened by the securing device 43 to the mounting surface 12, any movement upward or sideward of the decorative panel 42 can be effectively prevented. Further, since the fastening of the decorative panel 42 to a mounting surface can be carried out by means of the securing device 43 which is capable of being magnetically adhered to the mounting surface. The installment of the decorative panels 42 can be easily conducted.

Figure 5:
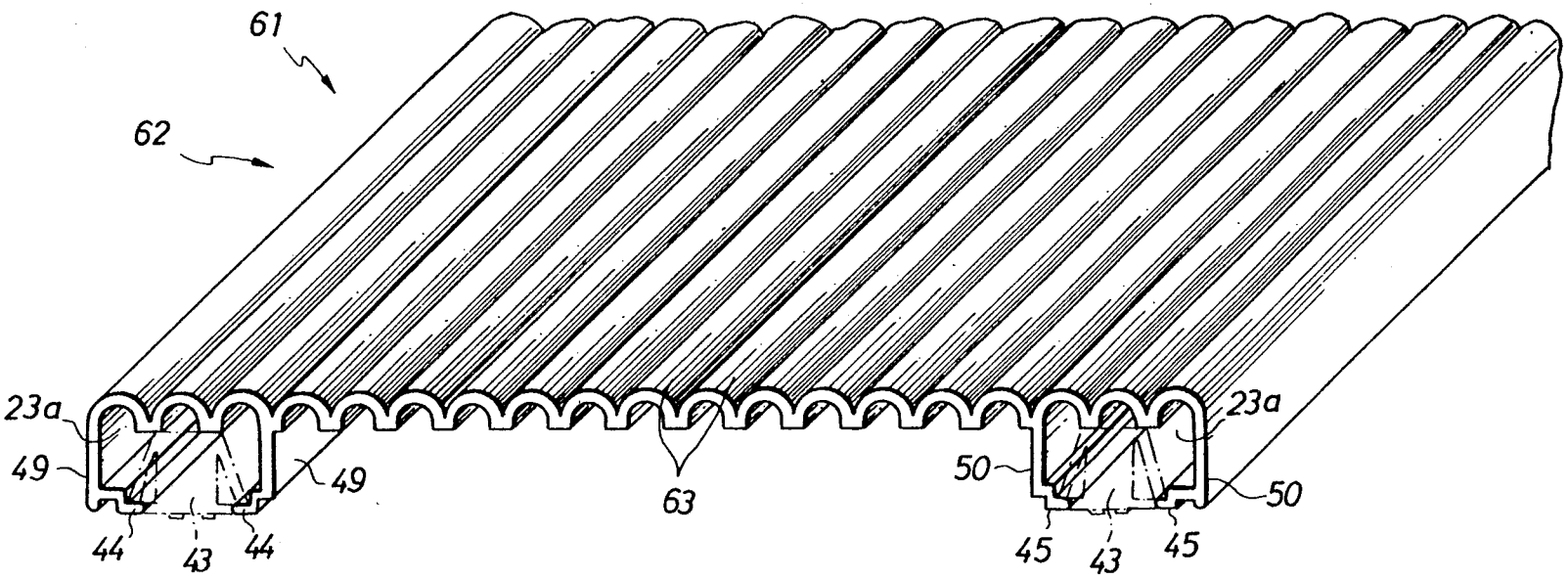
FIG. 5 is a perspective view of a decorative panel assembly according to another embodiment of this invention.

A decorative panel assembly 61 shown in FIG. 5 has a panel surface consisting of a repetition of semicircular shaped ridges 63 in cross-section. As in the case of above embodiments, two pairs of legs 49 and 50 are protruded backward from both sides of the panel 62. Other structures are substantially the same as those of above embodiment shown in FIG. 4(*a*).

According to this decorative panel assembly 61, a space 23*a* for accommodating the securing device 43 is substantially formed by each pair of legs 49 or legs 50. Therefore, the ridges 63 merely function as a decoration, and can be of any desired shape, such as a continuous corrugated shape, or other three-dimensional shape. Each pair of engaging portions 44 and 45, each having a bent forward portion, is protruded from the legs 49 and 50. These engaging portions are engaged with the magnetized securing device 43 as explained in reference to FIGS. 4(*a*) to 4(*c*).

In above embodiments, the securing device is engaged with a pair of engaging portions protruded from a pair of legs. However, the securing device may be engaged with only one engaging portion mounted on one of the legs. The engagement construction between the securing device and the panel is not restricted to above embodiments, but may take any desired construction.

It is also possible to mount the securing device at the inner portion of the decorative panel other than or in addition to the both sides thereof.

The decorative panel assembly of this invention may be modified such that a hook member can be mounted on the front surface of the panel, thereby allowing goods to be displayed on the panel.

Figure 6:
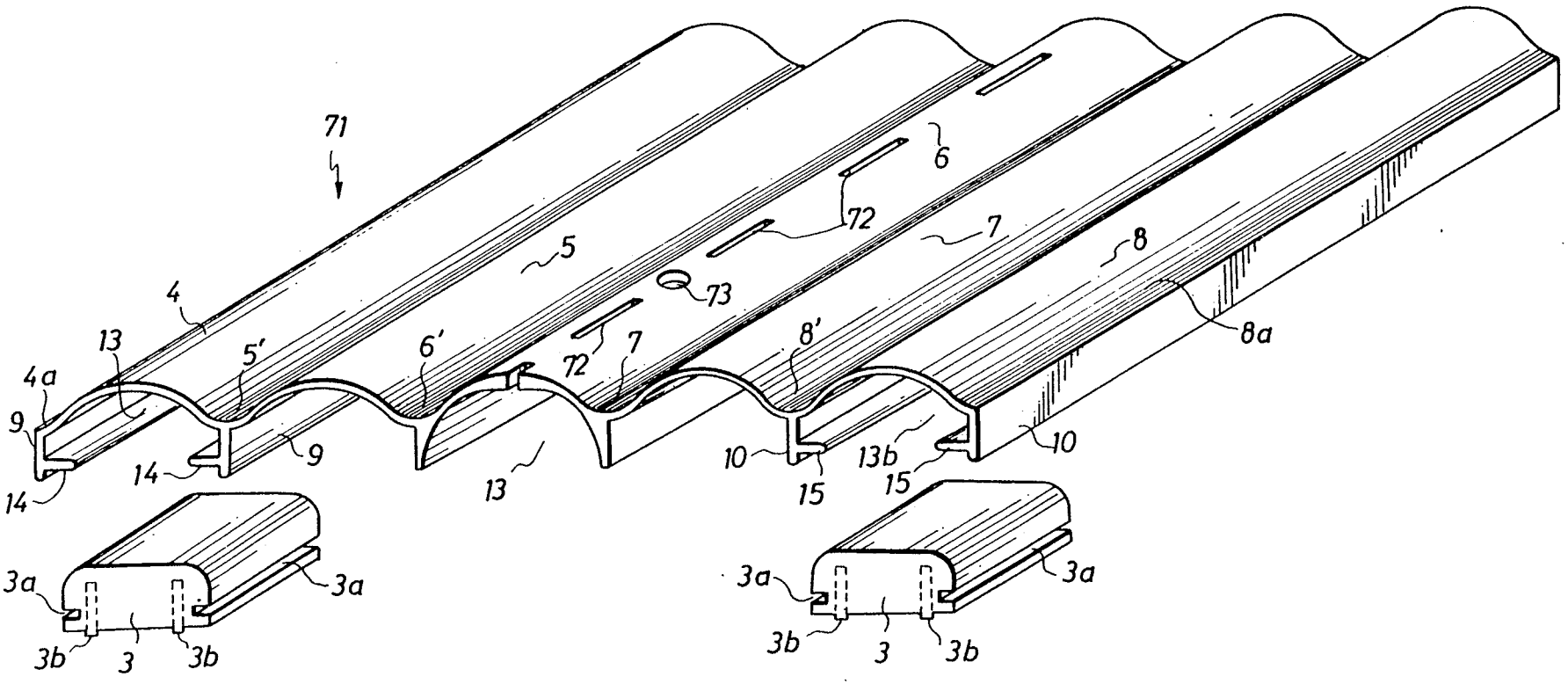
FIG. 6 is a perspective view of a decorative panel assembly according to still another embodiment of this invention.

FIG. 6 shows an example of such a modified decorative panel assembly. Namely, a decorative panel 71 is provided on and along the top portion of the central ridge portion 6 with a plurality of oblong through-holes 72 for fitting hook members at a predetermined interval. At one or a few middle portions between the through-holes 72 are also provided with a through-hole 73 for fastening the decorative, panel 2 to a mounting surface with a screw. With this construction, it is possible to firmly keep the panel 71 even if a heavy load is applied to the panel 2.

One or more hook members may be fitted in any one of the through-holes 72, and then a shelf, a hanging member or other kinds of displaying member may be supported on the hook members, thereby allowing any goods to be displayed thereon.

Other constructions are the same as those of the embodiment shown in FIG. 1, so that detailed explanations thereof are omitted by putting the same reference numerals thereto.

Figure 7:
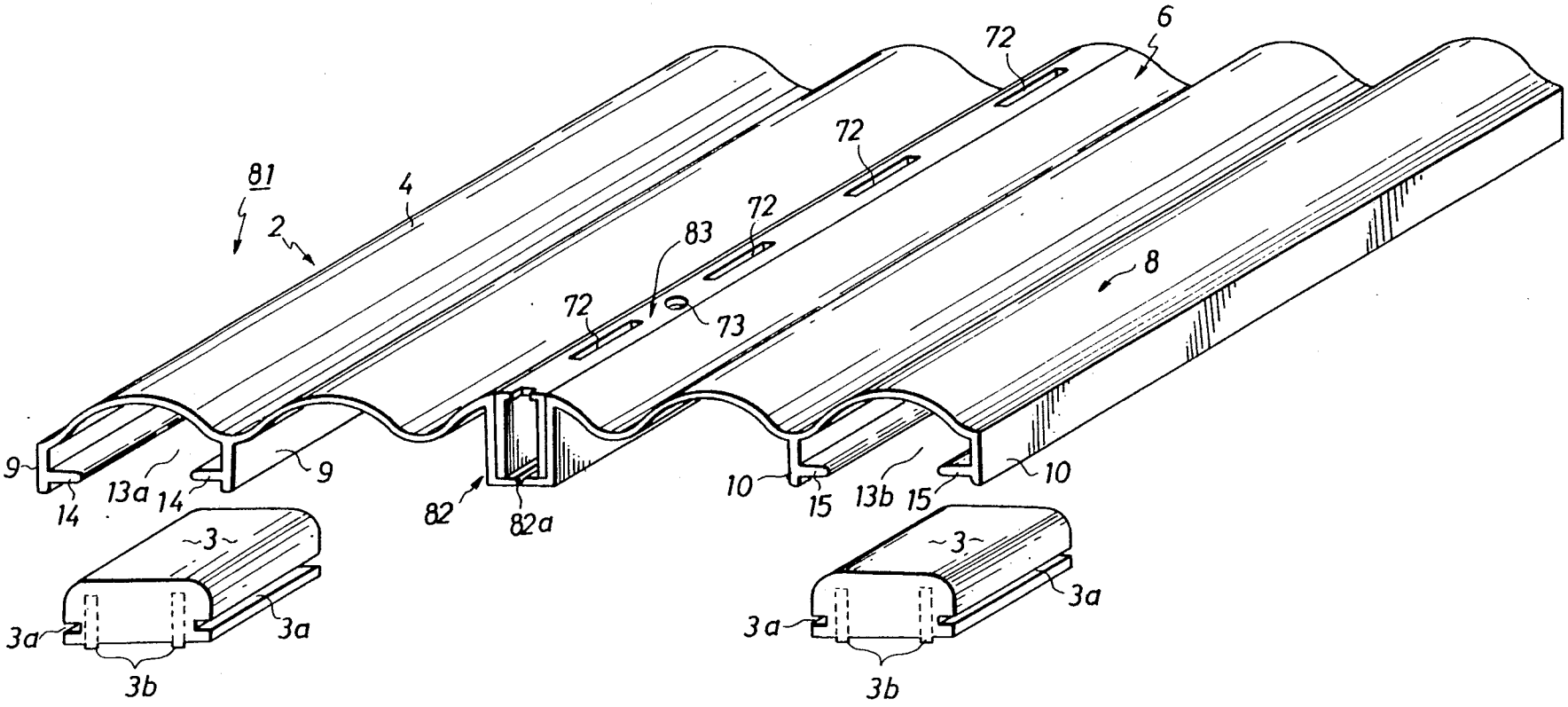
FIG. 7 is a perspective view of a decorative panel assembly according to a further embodiment of this invention.

FIG. 7 shows another example of a modified decorative panel assembly 81, which is quite similar to the panel assembly shown in FIG. 1 except that a groove 82 is provided on and along the top portion of the central ridge portion 6. In this case, a channel-like support member 83 having a plurality of through-holes 72 for fitting hook members at a predetermined interval is snugly fitted and fixed in the groove 82.

To be more specific, a V-shaped groove 82*a* is formed at the middle portion of the bottom of the groove 82, so that a screw which is inserted into a through-hole 73 formed on the top surface of the support member 83 can be easily pierced through the bottom of the groove 82*a*.

The support member 83 is fitted into the groove 82 and then fixed not only to the decorative panel 2 by means of a screw, but also to the mounting surface 12 or the wall 11 together with the decorative panel 2.

In this case, the decorative panel 2 is fixed to a mounting surface by means not only of the magnetic force of the securing device, but also of the fixing force of a screw.

In this case, hook members may be attached to the support member 83, and then a shelf, a hanging member and the like can be supported thereon.

Other constructions are the same as those of the embodiment shown in FIG. 1, so that detailed explanation thereof are omitted by putting the same reference numerals thereto.

Figure 8:
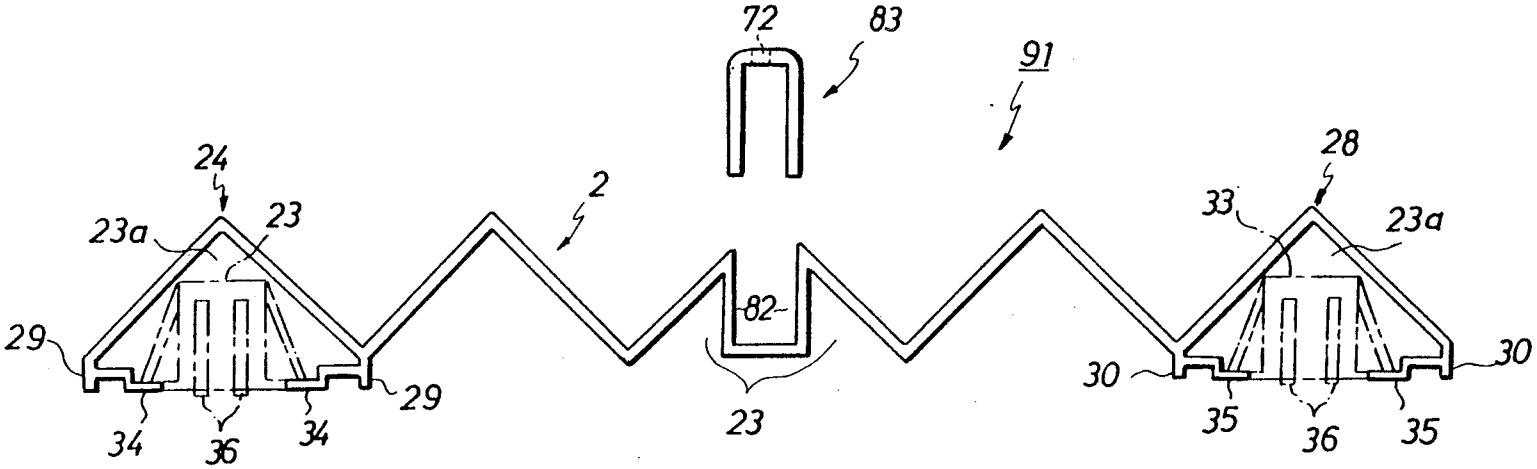
FIG. 8 is a top view of a decorative panel assembly according to another embodiment of this invention.

FIG. 8 shows another embodiment of decorative panel assembly 91 which is quite similar to the embodiment shown in FIG. 3, except that the same combined structure of a groove 82 and a channel-like support member 83 as explained with reference to FIG. 7 is applied thereto.

Therefore, detailed explanations thereof are omitted by putting the same reference numerals as shown in FIGS. 3 and 7.

Figure 9:
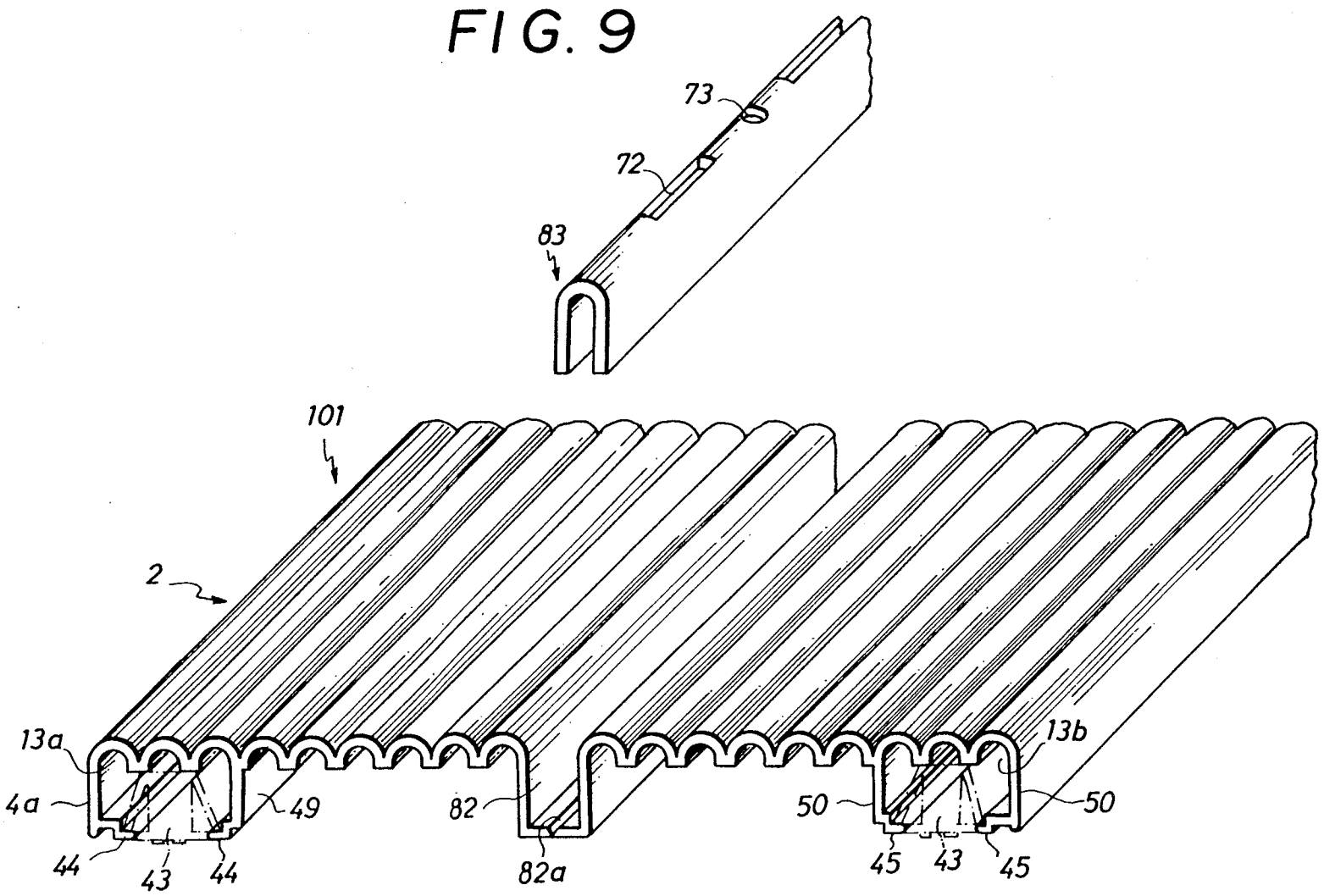
FIG. 9 is a perspective view of a decorative panel assembly according to a further embodiment of this invention.

FIG. 9 show another embodiment of decorative panel assembly 101 which is quite similar to the embodiment shown in FIG. 5, except that the same combined structure of a groove 82 and a channel-like support member 83 as explained with reference to FIG. 7 is applied thereto.

Therefore, detailed explanations thereof are omitted by putting the same reference numerals as shown in FIGS. 5 and 7.

It is also possible within spirit of this invention to modify the engaging angle of the decorative panel mentioned in the above embodiments. For example, a decorative panel may be engaged to be rotated at an angle of 90 degree.

What is claimed is:

1. A decorative panel assembly comprising:

a decorative panel having opposite sides and opposite ends, two pairs of legs extending from one of said sides, one leg of each pair being located at a said opposite end with the other leg of said pair spaced a selected distance from said one leg, each said leg having a projection extending therefrom toward the other leg of said pair, said legs defining a space on said one side of said panel between said panel and a mounting surface, a securing device including a magnet for magnetically securing said device to a mounting surface, said device having receiving means for receiving said projections of a said pair of legs to attach said panel to said device to thereby prevent said panel from being detached from said mounting surface.

2. A decorative panel assembly according to claim 1, wherein said decorative panel is provided with at least one through-hole for fitting a hook member, and with at least one through-hole for fastening with a screw.

3. A decorative panel assembly as claimed in claim 1, wherein said panel is of corrugated shape in which ridge portions and trough portions are alternately repeated from one of said ends toward said opposite end.

4. A decorative panel as claimed in claim 1, wherein said decorative panel has intermediate said ends a groove formed therein extending substantially parallel to said pairs of legs, said groove receiving a channel like support member therein with said support member having a through hole for fitting a hook member.

5. A decorative panel assembly according to claim 1, wherein said decorative panel is of a wave-like shape in cross-section.

6. A decorative panel assembly as claimed in claim 1, wherein said panel is formed to have alternate sharp-edged ridge portions and sharp-edged bottom portions alternately repeated from one end to the opposite end.

7. A decorative panel assembly as claimed in claim 3, wherein one leg of each said pair extends from a trough portion of said panel.

8. A decorative panel assembly as claimed in claim 1, wherein said receiving means of said securing device is a groove for receiving a said projection of a said leg.

9. A decorative panel assembly as claimed in claim 3, wherein said securing device has an inner side which faces said panel when said panel is attached to said securing device, said securing device having a pair of fastening fins extending from said inner side and being resiliently connected thereto, said fastening fins each having lower ends located adjacent the side of said securing device opposite said inner side thereof, said fastening fins being bendable toward said opposite side of said securing device to allow said securing device to be inserted between said legs of a said pair and then to be restored so as to engage said projections of said legs of said pair to prevent said decorative panel from being detached from said securing device.

* * * * *